United States Patent [19]

Fusselman et al.

[11] 4,258,963

[45] Mar. 31, 1981

[54] ADJUSTABLE DESK

[75] Inventors: Robert M. Fusselman; Leo Terlecki, both of Youngstown, Ohio

[73] Assignee: GF Business Equipment, Inc., Youngstown, Ohio

[21] Appl. No.: 81,252

[22] Filed: Oct. 1, 1979

[51] Int. Cl.[3] ..... A47B 47/04

[52] U.S. Cl. ..... 312/194; 108/141; 312/196; 312/209

[58] Field of Search ..... 312/194, 195, 239, 253, 312/277, 281, 208, 209, 223; 108/92–95, 140, 141

[56] References Cited

U.S. PATENT DOCUMENTS

| | | | |
|---|---|---|---|
| 1,046,479 | 12/1912 | McPherson | 108/140 |
| 1,892,415 | 12/1932 | Ulrich | 312/208 |
| 2,362,047 | 11/1944 | Center et al. | 312/194 |
| 2,928,703 | 3/1960 | Paulsen | 312/194 |
| 3,434,768 | 3/1969 | Schreyer | 312/194 |

FOREIGN PATENT DOCUMENTS

| | | | |
|---|---|---|---|
| 1151639 | 7/1963 | Fed. Rep. of Germany | 312/195 |
| 465170 | 12/1968 | Switzerland . | |

*Primary Examiner*—Casmir A. Nunberg
*Attorney, Agent, or Firm*—Emory L. Groff, Jr.

[57] ABSTRACT

An improved desk includes a top supported by opposite end assemblies and in turn supporting a juxtaposed end of an extension top having an end assembly at its opposite free end. The juxtaposed end of the extension top is attached to the desk top by a mounting assembly allowing of both vertical as well as horizontal displacement of the extension thereabout. The desk and extension end assemblies each are provided with a lowermost vertically adjustable leg unit permitting selective, independent variation of the height of the desk and extension tops both with respect to the underlying floor and with respect to one another. Manipulation of the leg unit adjustment is facilitated by the inclusion of a snap-out panel manually removable from each end assembly. At the time of manufacture, a plurality of series of fastener components are preferably provided beneath the desk top to allow ready field attachment of either a left-hand or right-hand extension and alternatively, the addition of a right-hand or left-hand storage unit, respectively.

28 Claims, 9 Drawing Figures

ADJUSTABLE DESK

This invention relates generally to office appliances and more particularly, to an improved multi-top desk including an extension component adjustably attached to a main desk component.

Office desks having more than one planar work or support surface are generally well known. Many prior devices include a desk having a stationary top cooperating with an auxiliary work top which is either fixedly attached to the main desk work top or mounted thereto alternately to provide a retracted, stored position or an extended, use position. Such displaceable auxiliary work tops often are slidably or pivotally attached to the main desk component or, attached thereto by a combined rectilinear-pivotal mechanism. Storable typewriter supports are an example of a displaceable desk top extension while additionally, L-shaped desk assemblies serve as an example of a desk having a fixedly attached extension combined with a main desk component.

The usefulness and flexibility of many of the prior desk assemblies having an adjustable component is somewhat restricted when considered in light of the advantages offered by the present invention. Today's technology has brought forth the use of new devices associated with personnel working behind desks. These devices include electronic components such as cathode ray terminals (CRT) which the user must have readily available but frequently one is not needed. In the latter instance it is desirable to provide means allowing the operator to temporarily displace the CRT or other device laterally of their seated position.

Two examples of the feasibility of such laterally displaceable feature are as follows. In the credit department of any large business CRTs are used to permit the department employee to obtain immediate access to any of the credit records on file and often an inquiring visitor may be seated on the other side of the desk. In such an instance, the department employee would like to maintain a degree of security of the data being displayed by the CRT and this may be readily achieved if the terminal is mounted upon a work top which may be laterally displaced to shield its screen from the eyes of the visitor. Another example of the desirability of having a displaceable work top associated with a main desk top would be in the inventory control department of a business concern. In this latter instance CRTs are often employed in periodic use, that is, during certain periods of the day any one operator may be scheduled for access to the main computer. By the present invention, the pivotally attached extension supporting the electronic equipment is readily swung out of the way of the user when its use is not required, thereby giving the user more freedom of movement in the area of the knee-hole and top of the main desk.

Substantially similar end support assemblies are provided on both ends of the desk as well as the distal portion of the extension and each assembly includes a vertically adjustable leg unit having means for attachment to the balance of the end assembly normally concealed behind a manually removable flush end panel such that with a simple tool, the height of both the desk and extension tops may be varied with respect to the underlying supporting floor. Additionally, means are provided to allow relative motion between the adjustable elevation of the desk and extension tops and this includes a mounting assembly having a pair of pivotally joined brackets attached respectively, to the adjacent undersurfaces of the desk top and extension top. The joined brackets not only allow pivotal horizontal displacement of the extension but also, through the manipulation of an actuating handle, permit the vertical displacement of the extension top relative the desk top.

Accordingly, one of the objects of the present invention is to provide an improved adjustable desk assembly including a desk having an extension with the tops of the two components joined in a justaposed manner by a mounting assembly allowing of both horizontal swinging displacement of the extension as well as vertical displacement thereof with respect to the desk top.

Another object of the present invention is to provide an improved adjustable desk assembly including a desk top provided with series of fastener components therebeneath duplicated on either side of the center of the desk top to allow alternate attachment by the user of either or both an adjustable extension and a pedestal to provide a left-hand or a right-hand installation.

Still another object of the present invention is to provide an improved adjustable desk assembly including a desk having an extension pivotally attached thereto with end assemblies on both the desk and extension and all of which are provided with leg units vertically adjustable with respect to each end assembly to independently alter the height of both the desk top and extension top.

A further object of the present invention is to provide an improved adjustable desk assembly including a main desk top having an extension top pivotally attached thereto about a fixed vertical axis by means of a mounting assembly allowing of either or both selective vertical and arcuate displacement of the extension top with respect to the top supporting surface of the desk.

With these and other objects in view which will more readily appear as the nature of the invention is better understood, the invention consists in the novel construction, combination and arrangement of parts hereinafter more fully described, illustrated and claimed.

A preferred and practical embodiment of the invention is shown in the accompanying drawings in which.

Similar reference characters designate corresponding parts throughout the several figures of the drawings.

Figure 1:
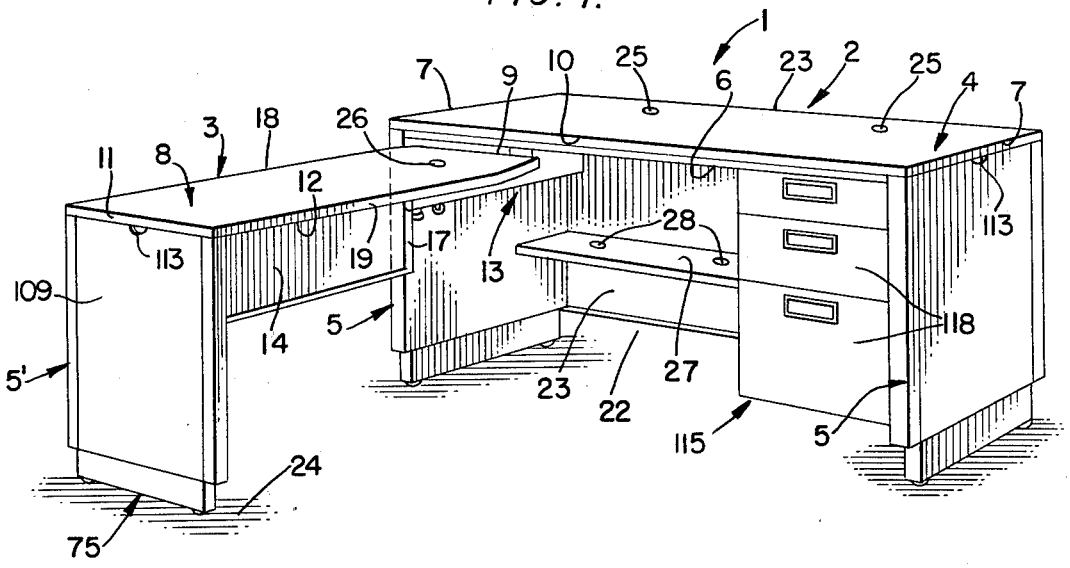
FIG. 1 is a front perspective view of an adjustable desk assembly according to the present invention.

Referring now to the drawings, particularly FIG. 1, the present invention will be seen to comprise an adjustable desk assembly generally designated 1, comprising two principal components, namely a desk 2 and an adjustable extension 3. The desk 2 is provided with a top 4 which is preferably planar and is supported by means of a pair of end support assemblies 5 suitably affixed to the undersurface 6 of the top adjacent its end edges 7—7. The extension 3 likewise preferably includes a planar top 8 having an inner end 9 juxtaposed the desk top front edge 10 and an outer edge 11 supported by an end assembly 5' suitably affixed to its undersurface 12. As will be seen hereinafter the construction of the end assemblies 5 anf 5' is basically similar although the width or lateral extent of the extension end assembly 5' will usually be less than that of the two desk end extensions 5. The relative planar dimensions of the desk and extension tops is typically as shown in FIG. 2 wherein the extension top 8 is of a width slightly less than the depth of the desk top 4 while its length extending from the desk top edge 10 is equal to greater than one-half of the desk top 4.

The inner end 9 of the extension top 8 is connected to the desk top 4 by means of a mounting assembly, generally designated 13, the details of which will be described later on.

Figure 2:
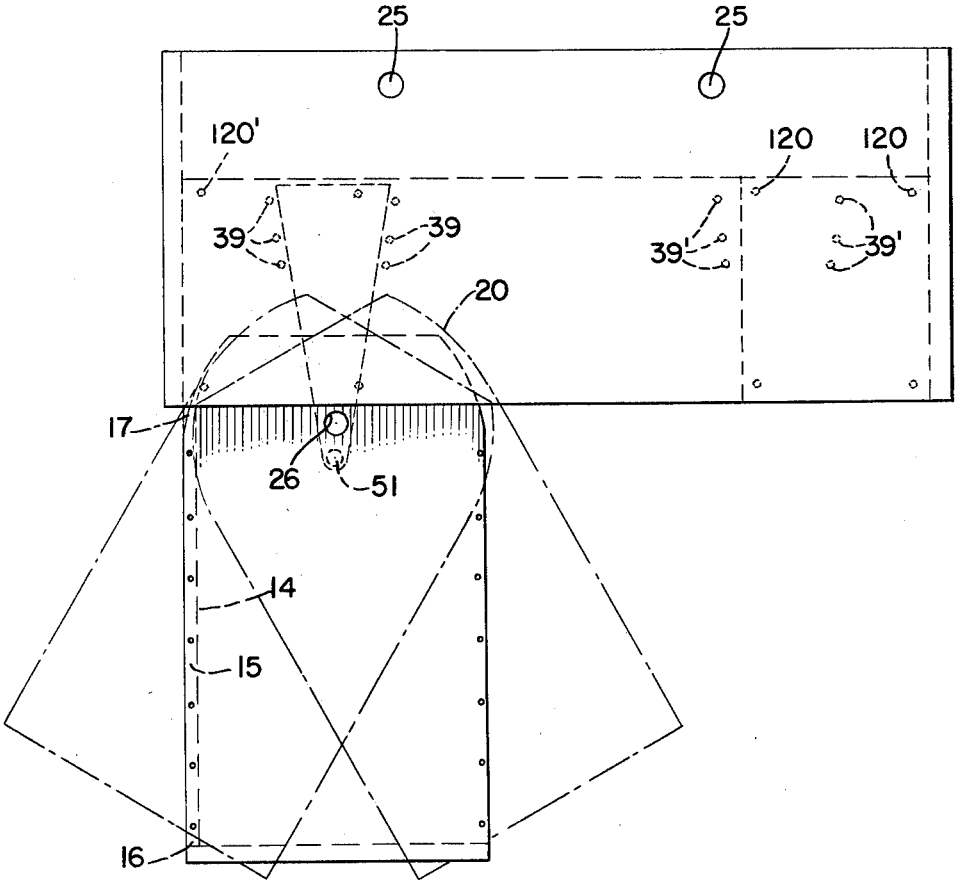
FIG. 2 is a top plan view of the structure of FIG. 1 and illustrates the limits of lateral displacement of the extension.

The arrangement shown in FIGS. 1 and 2 of the drawings illustrates what may be referred to as a left-hand installation that is, the extension 3 is located adjacent the left-hand end assembly 5 and will be adjacent the left-hand of a user located behind the desk 2. With this arrangement, the extension component 3 is provided with a side or modesty panel 14 having its upper edge 15 attached by means of removable fasteners to the undersurface 12 of the extension top as shown in FIG. 2 of the drawings. The outer edge 16 of this panel 14 is likewise suitably attached to the end assembly 5' while the inner edge 17 is free-standing and will be seen to be disposed in a vertical plane substantially flush with the plane of the edge of the justaposed desk end assembly 5.

Both the left-hand and right-hand edges 18 and 19 respectively, of the extension top 8 will be seen to be inwardly relieved or curved as at 20, in the area adjacent the top inner end 9. From a review of FIG. 2 of the drawings it will be seen that when the extension 3 is pivoted to its limit of displacement in either direction, the straight inner edge 21 remains at all times beneath the undersurface 6 of the desk top 4 while the two rounded or curved portions 20 are alternately exposed or masked by the desk top 4. This construction serves two primary purposes. First, is the safety factor. With this rounded construction there are no sharp right-angle corners exposed outside the confines of the desk top 4 when the extension is moved to the left-hand most position of FIG. 2 and this precludes a user of the desk assembly from striking an otherwise sharp corner or being pinched between such a corner and the front edge 10 of the desk top when the extension is returned to the full line position of FIG. 2. Secondly, the rounded portions 20—20 allow for preservation of the maximum open area when a user is seated behind the desk and occupying the knee-hole space 22 thereof. It will be appreciated, that without the relieved edges 20—20 the angularly displaced extension would jut outwardly into the area normally occupied by a person seated behind the desk.

The knee-hole 22 of the desk 2 is covered by a rear or modesty panel 23 suitably affixed beneath the rear edge 23 of the desk top and extending between the desk end assemblies 5—5. As previously discussed, the instant invention is extremely useful in a working environment involving the use of electronic components such as computer terminals and in such instance means must be provided to allow ready access between the electronic equipment and its attendant wiring. Usually this wiring is supplied to the area of each desk assembly from a conduit located within the supporting floor 24 and means must be included to enable feeding of this wiring to various areas of the desk assembly. As shown in FIG. 1 of the drawings, the desk top 4 is provided with a pair of spaced apart wire access holes 25—25 while the extension top 8 is provided at least one wire access hole 26 preferably adjacent the desk top front edge 10 but far enough away from same so that the extension is laterally displaced as in FIG. 2 this hole 26 will at all times remain clear of or outside the desk top undersurface 6. In order to allow flexibility in the arrangement of desk locations it will be appreciated that usually the wiring supplied to each desk assembly will be considerably excessive in length and thus means must be provided to safely store or contain such excess. Accordingly, the present invention includes a wire management shelf 27 extending the full extent of the desk and provided with a plurality of wire access holes 28 therethrough. This shelf 27 may readily be attached to the desk 2 by means of a hanger flange (FIG. 6) attached to the inner surface of the panel 23 and to which the rear edge 30 of the shelf is attached. Complete stabilization of the shelf is achieved by suitable means such as removable fasteners 31 disposed through the side edges 32 and into the juxtaposed end assemblies 5.

Figure 4:
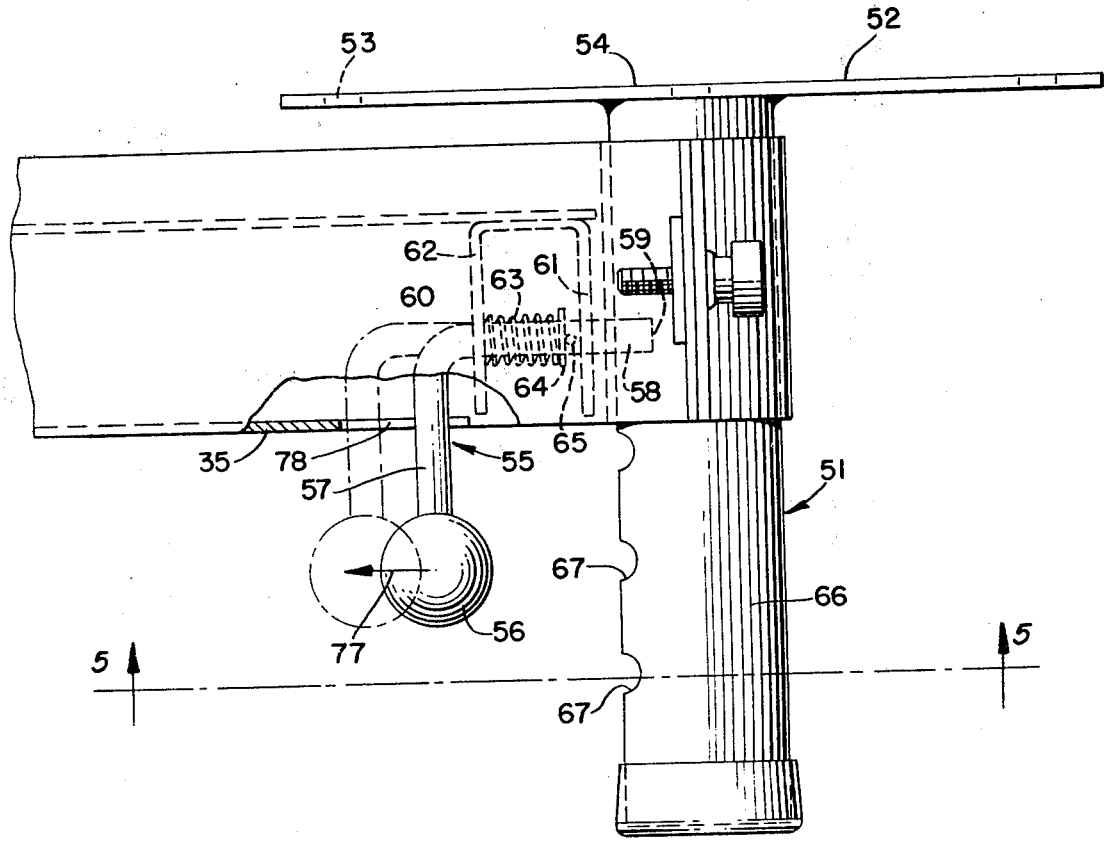
FIG. 4 is an enlarged fragmentary side elevation taken along the line 4—4 of FIG. 3.
Figure 5:
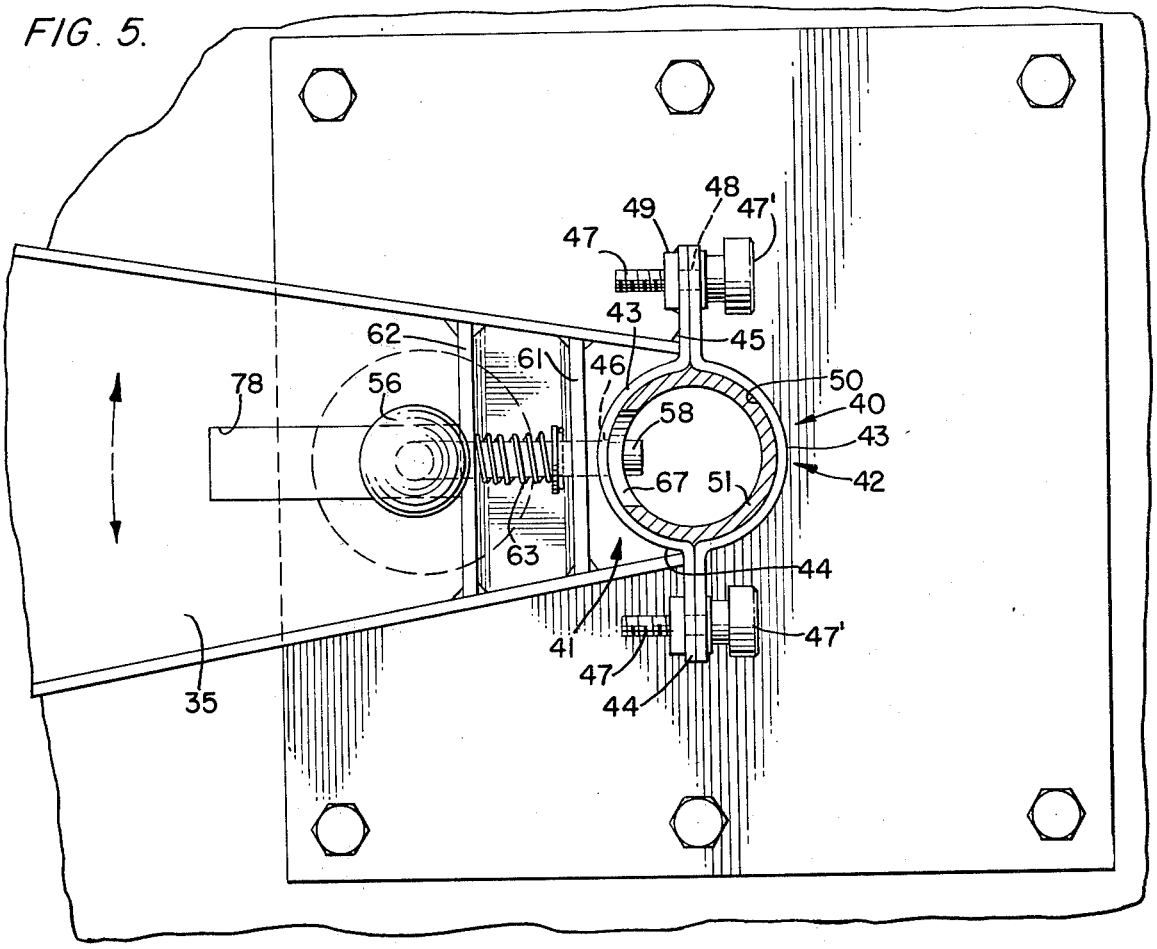
FIG. 5 is a bottom plan view taken along the line 5—5 of FIG. 4.
Figure 6:
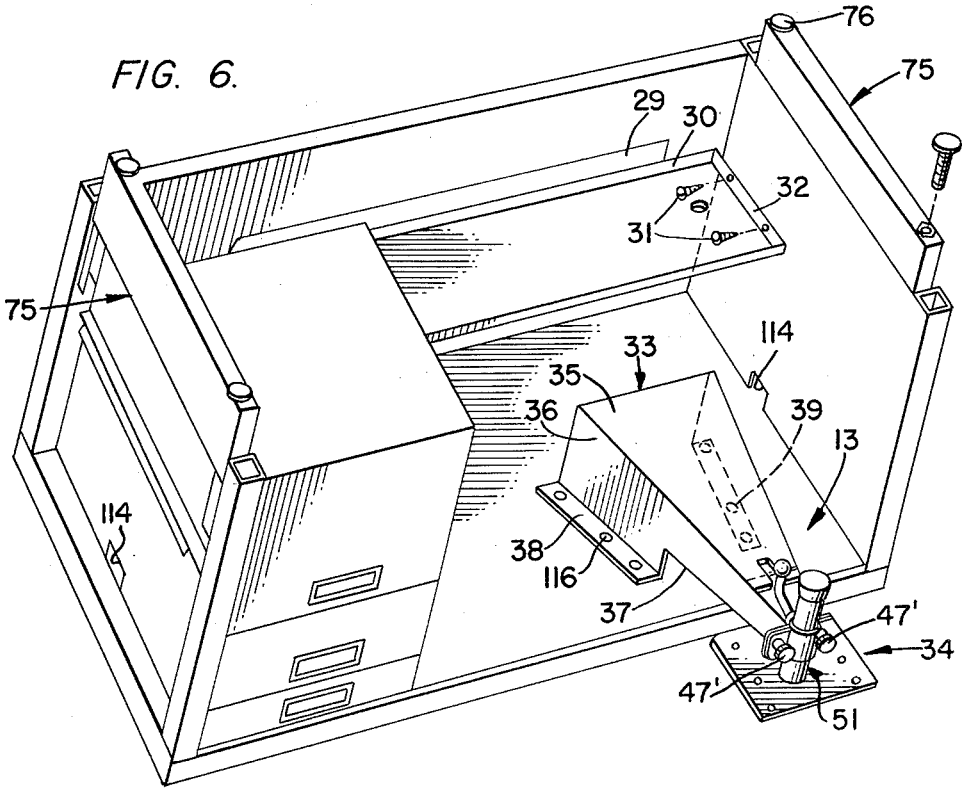
FIG. 6 is a bottom perspective view of the main desk and extension mounting assembly.

The description of the mounting assembly 13 serving as the sole support for the inner end 9 of the extension will now be described, with particular reference being made to FIGS. 4–6 of the drawings. This mounting assembly includes a desk top bracket 33 joined to an extension top bracket 34. The desk bracket 33 is provided with a base 35 joined to a pair of vertical side walls 36—36. These side walls are cut away as at 37 and extend outwardly from beneath the desk top 4 in a cantilever manner to a point well beyond its front edge 10 as shown most clearly in FIG. 6. That portion of each side wall 36 disposed rearwardly of the cut-out area 37 extends further in a vertical direction and terminates in an attachment flange 38 provided with a plurality of openings 39 therethrough.

The forward distal portion of the two side arms 36—36 will be understood to be disposed in a plane substantially beneath that of the desk top undersurface 6 and serve to support clamping or securing means 40 comprising a first collar segment 41 and a second collar segment 42. Each collar segment 41 and 42 comprise a pair of mating semi-circular bearing sections 43—43 having lateral flanges 44—44 extending therefrom. The first collar segment 41 is permanently affixed to the desk bracket 33 such as by the welds 45 bonding the segment to the distal portion of the side walls 36—36 and this segment will be understood to be provided with a single radial bore 46 axially aligned with the longitudinal center axis of the bracket 33 for purposes which will become apparent thereinafter.

The second collar segment 42 is intended to be releasably secured with respect to the first collar segment 41 and this may most readily be achieved by the use of suitable releasable fasteners such as the illustrated bolts 47 disposed through the mating flange holes 48 and engageable with the weld nuts 49. The heads of the bolts 47 are shown provided with hand knobs 47' so that the clamping force exerted by two two collar segments may be quickly varied by a user merely by manipulating the knobs 47'. Quite obviously any other type of releasable fasteners may be employed, including manually operable fasteners such as wing nuts cooperating with bolts welded to one of the collars or optionally, bolts may be utilized having crank handles welded to their heads.

The circular bore 50 provided by the assembled clamping/securing means 40 will be understood to have its central axis vertically and fixedly disposed and this bore serves to receive and retain vertical and arcuate displacement means comprising the circular pivot member 51 of the extension bracket 34.

The pivot member 51 is intended to depend from the undersurface 12 of the extension top 8 and is fixed with respect thereto by means of the attachment plate 52 which is secured such as by welding, to the top of the member 51. The plate 52 is planar and includes a plurality of mounting holes 53 for the reception of appropriate fasteners designed to retain the upper surface 54 of the plate rigidly secured to the extension top undersurface in an area spaced from the top inner edge 21. It will be understood that the diameter of the pivot member 51 is selected such that when the fasteners 47—47 of the clamping means 40 are tightened, the extension bracket 34 and its connected top 8 will be locked against relative movement therewith.

Limits are insured with respect to both the vertical and angular displacement of the extension bracket and its attached extension 3. The means providing this limitation is most clearly illustrated in FIGS. 4 and 5 of the drawings and it will be seen to include operating or actuating means in the form of a shiftable bolt 55 having a manually engageable handle or knob 56. The bolt includes a vertical handle portion 57 joined to the horizontal latch portion 58, the latter of which terminates in an end face 59 disposed through the radial bore 46 in the first collar segment 41. The actuating means is mounted such that the bolt latch portion 58 will be capable of reciprocating motion and this is achieved by supporting the bolt with its latch portion disposed through holes 60 in the fixed and spaced apart forward guide plate 61 and rearward guide plate 62. A compression spring 63 surrounding the bolt latch portion 58 bears on one hand against the rear guide plate 62 and on the other hand against a spring abutment carried by the bolt, such as the washer 64 which will be seen to be retained by means of the cotter pin 65.

As above described, it will be apparent that the distal or end face 59 of the bolt will at all times be urged toward the direction of the bore 50 formed by the clamping means 42 and inasmuch as the circular pivot member 51 of the extension bracket 34 is disposed within this bore 50, it will follow that the bolt will be spring-urged towards engagement with the periphery 66 of the pivot member 51. The periphery 66 of this member is imperforate with the exception of a plurality of horizontal slots 67 serving as limit means for displacement of the extension bracket 34. The slots are preferably equi-spaced and disposed in a common vertical plane. Since the arc described in the horizontal plane by each slot 67 is preferably 60° as shown in FIG. 5 of the drawings, this will allow of a 30° displacement of the extension 3 to either side of an axis normal to the length of the desk 2 which displacement is reflected by the broken line illustrations shown in FIG. 2 of the drawings. Thus, it will be seen that by vertically displacing the extension top 8 a different one of the plurality of slots 67 will be raised or lowered until the extension is positioned at the level desired at which time the nearest slot 67 is moved to a vertical location co-planar and juxtaposed the face 59 of the bolt 55. At this point the latch portion 58 of the bolt will be urged by the spring 63 through the aligned radial bore 46 and adjacent slot 67 to establish a fixed vertical positioning of the extension bracket 33 and top 8.

With the foregoing structure of the mounting assembly 13 in mind, the manipulation of the mechanism to achieve both the vertical and lateral displacement of the extension 3 with respect to the desk 2 should now be readily clear. A user need only release the clamping force produced by the tightened fasteners 47—47 in order to arcuately move the extension 3 anywhere between the limits defined by the broken line portions in FIG. 2 of the drawings. The end assembly 5' of the extension as well as the end assemblies 5—5 are provided with lowermost adjustable leg units 75 each of which includes a pair of spaced aprat glides 76. By providing an appropriate composition for the bottom face of these glides 76 it will be apparent that the pivotal displacement of the outer end of the extension will be an effortless manuever once a user has released the fasteners 47—47. Usually the fasteners 47—47 are maintained in the loosened condition with the well supported and guided bolt latch portion 58 serving to support the extension inner end 9 as its weight is transmitted through the extension bracket 34 and its slot 67 engaging the bolt latch portion 58. Thereafter, at any time a user desires to vary the elevation of the extension 3 they need only reciprocate the bolt 55 in the direction of the arrow 77 of FIG. 4 of the drawings from a first position (full lines) to a second position (broken lines) so as to retract the distal face 59 of the bolt from its surrounding slot 67, after which the extension top and its bracket 34 may be raised or lowered to position another one of the slots 67 juxtaposed the bolt end face 59. As shown in FIGS. 4 and 6 the bottom wall 35 of the desk bracket 33 extends to the rear guide plate 62 but is slotted, as at 78, along its center axis, to receive the vertical handle portion 57 of the bolt and thus provides lateral stability thereto and insures that the bolt is operated only in a rectilinear fashion.

Quite obviously as the mounting assembly 13 is manipulated to vary the height of the extension top, means must be provided to similarly alter the elevation of the outer end 11 of the extension top. This means includes the adjustable leg units 75 which not only provide for variation of the height of the extension top 8 but similarly allow the user to vary the height of the desk top 4. Accordingly, the description of the leg unit 75 associated with the extension 3 will serve to explain the similar structure associated with the end assemblies 5—5 of the desk.

Figure 7:
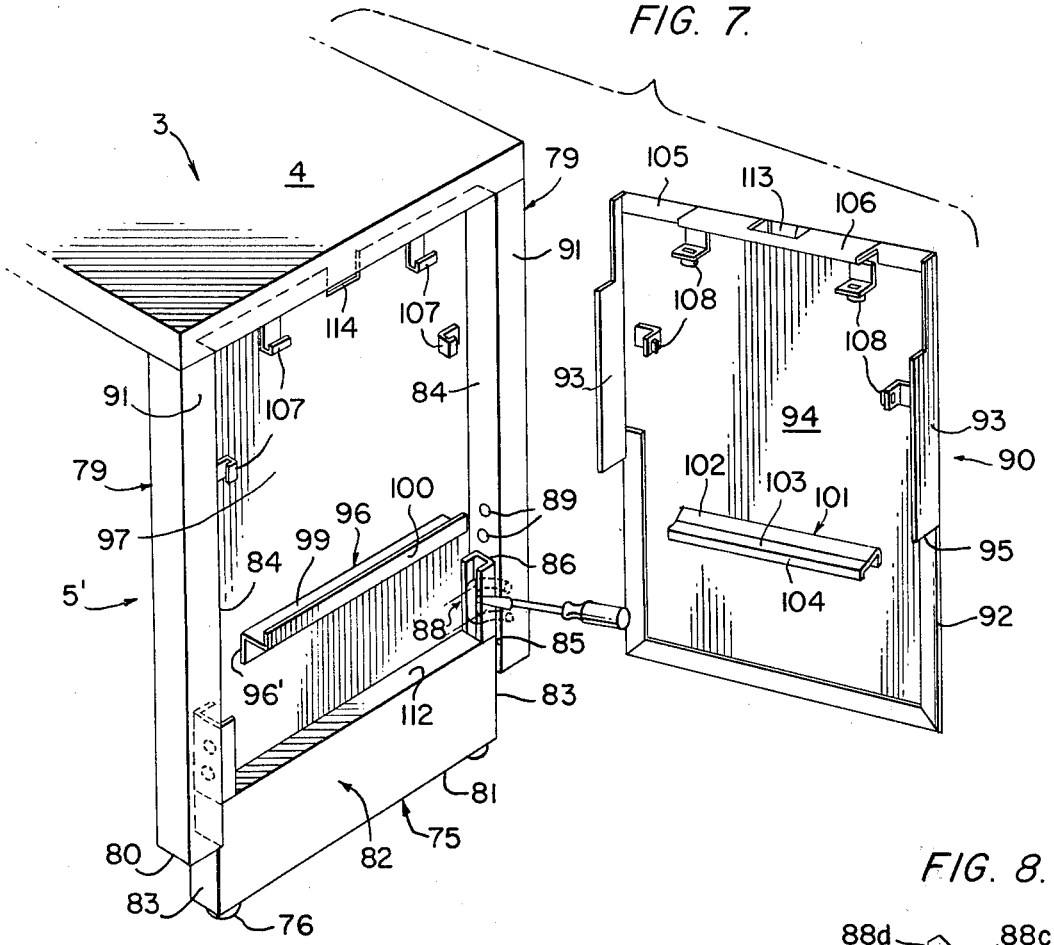
FIG. 7 is an exploded view of one of the end assemblies with the end panel removed.

The exploded view of FIG. 7 of the drawings illustrates the height adjustment mechanism associated with the end assembly 5' of the extension 3. Each end assembly includes a pair of corner elements 79—79 extending from the undersurface 12 of the top downwardly to a bottom 80 which is not intended to engage the supporting floor 24. This floor engagement is provided by the bottom surface 81 of the adjustable leg unit and more particularly, by the glides 76—76 projecting therefrom. The leg unit 75 includes a base having opposite sides 83—83 providing a close sliding fit between the spaced apart inner walls 84 of the two corner elements 79 and the depth or thickness of this base 82 is less than that of the inner walls 84 so as to provide the clearance 85 for reasons which will become obvious hereinafter. Projecting upwardly from each of the leg unit sides 83 is a mounting element or channel 86 each having at least a pair of vertically spaced holes 87 for receiving fastener 88 adapted to enter selective ones of a plurality of openings 89 formed in the inner wall 84 of the two corner elements 79.

Figure 8:
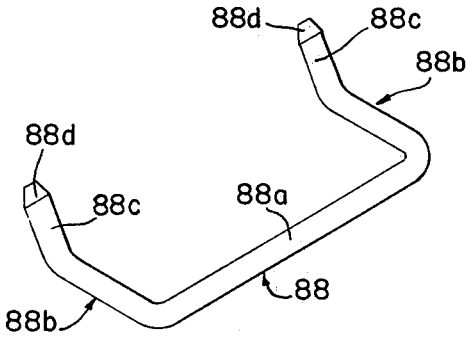
FIG. 8 is a perspective view of the hairpin fastener adjustably securing the leg unit of FIG. 7 to the end assembly.

Each fastener 88 preferably comprises a unitary hairpin element as shown most clearly in FIG. 8 having a base or handle portion 88*a* from which extend a pair of attachment legs 88*b*—88*b*. In end elevation each leg 88*b* will be seen to be bent in its medial area to provide the angled distal section 88*c* terminating in the taper 88*d*. The two legs 88*b* are in turn angled slightly inwardly toward one another when viewed in plan. With the above in mind the manner of varying the height of either the desk or extension top by manipulation of the adjustable leg units 75 should now be readily apparent. It is only necessary to remove the two hairpin fasteners 88 and to vertically re-position the channel mounting elements 86 so as to position each pair of holes 87 adjacent the desired corresponding pair of holes 89 so as to locate the bottom 81 of the leg unit the desired distance from the top 4 or 8. Then, the two legs 88*b*—88*b* of a hairpin fastener 88 are inserted through the aligned holes 87,89 to achieve the installed position shown in FIG. 7. During this insertion, the tapered terminus 88*d* of the two legs facilitates the initial entry of the inwardly angled distal sections 88*c* and continued insertion spring urges the two legs apart from one another until the distal sections are within the hollow interior of the corner elements 79.

The mounting elements 86 and fastener components 88 are conveniently hidden from observation by means of a removable end panel 90, vertically extending a distance which preferably corresponds to the length of the corner elements 79—79. This panel is constructed to provide a flush fit with respect to the end faces 91 of the corner elements 79 and accordingly, the thickness of the lateral edges 92 of the panel are constructed to correspond to the depth or thickness of the aforedescribed clearance 85.

No tools are required to remove the end panels 90 and self-contained means are provided to properly align the panel during installation and for snap-fittedly retaining same in the use position as in FIG. 1. The sides of each panel are provided with flanges 93—93 projecting beyond the rear surface 94 above the lateral edges 92. Each side flange 93 terminates with a bottom edge 95 disposed at an elevation sufficient to clear the top of the leg unit channels 86 when in their highest position.

A horizontal disposed Z-channel 96 is attached to the inside panel 97 within the confines of the cavity 98 formed between the panels 90,97 and corner elements 79—79 and includes end portions 96' spaced inwardly from the corner elements a sufficient distance to allow free passage of the channels 86 during adjustment thereof. The Z-channel includes a horizontal shelf portion 99 terminating in a vertical stop flange 100 as shown most clearly in FIG. 7A of the drawings. The Z-channel 96 cooperates, during attachment and removal of the end panel 90, with end panel channel 101 having a downwardly inclined portion 102 joined to a horizontal portion 103 which in turn terminates in a depending catch flange 104. With the foregoing structure in mind it will be understood that when the end panel 90 is in the assembled condition, the two channels 96,101 will appear as shown in full lines in FIG. 7A with the catch flange 104 disposed atop the shelf portion 99 juxtaposed the inside panel 97. The displacement of the end panel 90 and its channel 101 to the alternate position reflected by the broken lines in FIG. 7A will be discussed hereinbelow. The various elements of the end panel structure are formed so that a very close fit is achieved between the lateral edges 92 of the panel and the inner walls 84 of the corner elements and also between the upper edge 105 and the undersurface 12 of the extension top.

Figure 7A:
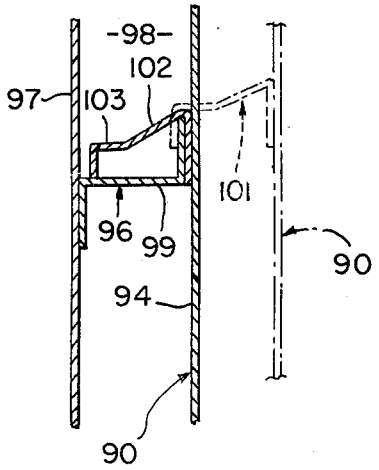
FIG. 7A is a fragmentary sectional view illustrating alternate positions of the engageable inside panel and end panel channels.

The panel 90 is moved to the closed position by initially placing the catch flange 104 behind the stop flange 100 whereupon the channels 96,101 will appear as shown in broken lines in FIG. 7A with the majority of the end panel weight then being supported by the horizontal portion 103 disposed atop the stop flange 100. Thereafter, with the panel 90 vertically and horizontally aligned by means of the side flanges 93 and the top flange 106, continued inward displacement of the panel in the direction of the frame or inside panel 97 produces engagement between a series of first fastener components 107 attached to the panel 97 and a corresponding number of second fastener components 108 carried by the rear surface 94 of the end panel 90. Any suitable fastener components 107–108 may be employed and the drawings illustrate the use of well known bullet type catches comprising a spring urged ball carried by one element and engageable within either a detent or behind a shoulder carried by a second element. In view of the horizontal and vertical alignment insured through the aforementioned flanges it will be appreciated that after the end panel 90 has been initially oriented within the confines of the structure defining the cavity 98, continued inward pressure on the end panel produces a snap-locking engagement between the respective fastener components 107–108 and a satisfactory locking of the end panel in position such as shown in FIG. 1 of the drawings wherein it will be noted that the exterior surface 109 of the end panels 90 are flush with the end walls 91 of the corner elements. Regardless of the vertical positioning of the base 82 of the leg units it will be understood that at all times when the end panels 90 are secured in position, the lower edge 110 thereof will overlap the outer face 111 of the base 82 and be disposed at a level beneath its top 112.

The top center portion of each end panel 90 is provided with a cut-out therethrough forming a combination finger-pull and wire access hole 113. This opening 113 is aligned with a similar wire access opening 114 formed in the frame panel 97 and thereby provides direct access for wiring from without the end assembly to any point beneath the desk top or extension top. The panel wire access opening 113 will be seen to serve the dual purpose of providing means by which one's fingers may be used to readily pull away the end panel 90 from its closed position and during this panel removal action, accidental dropping of the panel as the snap fasteners 107–108 become separated, is precluded in view of the captive disposition of the end panel channel catch flange 104 behind the inside panel channel stop flange 100. Thus, to fully remove the end panel it will be necessary to elevate the panel to clear the interlocked channels 96,101.

A further feature is attached to the relative positioning of the Z-channel 96 with respect to the uppermost ones of the holes 89 juxtaposed the ends 96' of the channel 96. When the leg unit 75 is elevated or collapsed with the mounting units 86—86 intermediate the uppermost holes 89 and the ends 96' of the channel 96 it will be appreciated that the channel ends 96' serve as blockage means precluding the accidental complete withdrawal of the hairpin clips 88 such as during shipping. It is but a simple matter to remove the angled legs **88*b* of the fastener 88 with an appropriate leverage tool such as illustrated in FIG. 7 thereby readily overcoming the natural retaining effort of the inwardly deflected clips legs 88*b*—88*b***.

Figure 3:
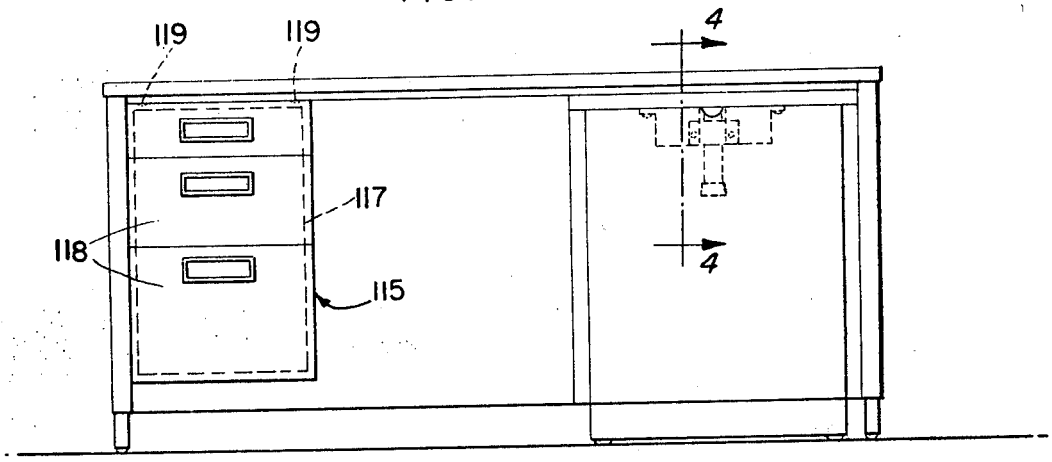
FIG. 3 is a front elevation showing an alternate attachment of both the extension and pedestal with respect to a desk top.

As previously mentioned, means are provided to readily facilitate the interchange of the extension 3 from the left-hand position of FIG. 1 to the right-hand position of FIG. 3. Along these lines it will be understood that the storage unit or pedestal 115 may likewise be changed from a left-hand to right-hand position and both of these transpositions may be readily accomplished in the field by the user without any special tools. As shown in FIG. 2 of the drawings, the under-surface 6 of the desk top 4 is initially constructed with not only the fastener components 39, such as screw holes, provided on one side of the desk but also a duplicate set of similarly arranged fastener components 39' are symmetrically located adjacent the other side of the desk. With such an arrangement it is a simple matter for a user to re-position the screw fasteners 116 and related mounting assembly 13 from one set of fastener components 39 to the other set 39' thereby quickly converting the desk assembly 1 from a left-hand to a right-hand arrangement. The pedestal 115 is constructed to permit similar ready conversion to either a left-hand or right-hand disposition and includes a pedestal or drawer case 117 containing any suitable arrangement of drawers or other components 118. The unit 115 then can be quickly fastened beneath the desk top 4 by means of appropriate removable fasteners 119 passing through the case 117 into fastener components or screw holes 120 already provided in the undersurface of the desk top. A similar arrangement of fastener components 120' is symmetrically disposed at the opposite end of the desk top to provide for the alternate mounting of the pedestal 115.

From the foregoing it will be seen that an improved adjustable desk assembly is provided enabling of both horizontal pivotal displacement of a desk extension as well as relative vertical adjustment of the extension top with respect to the desk top. A single pivot member combined with the reciprocating bolt allows both a restricted angular displacement of the planar extension top and also permits the selective positioning of the height of the extension top. The inner end of the extension top is preferably masked beneath the desk top at all times such that a multi-planar assembly is always present. In addition to improved means for varying the relative spaced and angular position between two top surfaces there is also provided ready means facilitating the vertical adjustment of end assemblies supporting both the desk and extension tops.

We claim:

1. An adjustable desk assembly including, a desk top having opposite end edges and front and rear edges, an end support assembly secured beneath said top adjacent each said end edge, an extension provided with a top attached to said desk and having inner and outer ends, beneath said desk top and substantially inwardly of said desk top front edge, an end support assembly secured beneath said extension top adjacent said outer end, said mounting assembly including a desk bracket attached to the undersurface of said desk top adjacent said front edge and projecting outwardly beyond said desk top front edge, an extension bracket attached to the undersurface of said extension top adjacent said desk front edge, vertically and arcuately displaceable means on said extension bracket joined to said desk bracket and having a vertical axis disposed outwardly of said desk top front edge, and manually operable actuating means on said mounting assembly shiftable from a first position defining limits of horizontal arcuate displacement of said extension bracket and its attached top, to a second position allowing vertical displacement of said extension bracket and its attached top relative said desk top whereby, operation of said actuating means allows selective horizontal and vertical displacement of said extension top about said vertical axis with said extension top inner end remaining beneath said desk top.

2. An adjustable desk assembly according to claim 1 wherein, each said end assembly includes a lowermost leg unit having means permitting both independent and concurrent vertical adjustment thereof.

3. An adjustable desk assembly according to claim 1 wherein, the length of said extension top is greater than one-half the length of said desk top.

4. An adjustable desk assembly according to claim 1 wherein, said extension top inner end is disposed adjacent one said desk end support assembly, a vertically disposed side panel attached beneath said extension top adjacent one side edge thereof, and said side panel includes an exposed inner edge juxtaposed said adjacent desk end support assembly.

5. An adjustable desk assembly according to claim 1 wherein, said mounting assembly desk bracket includes clamping means at one end engaging said extension bracket displaceable means, and said clamping means provided with releasable fasteners operable to alternately tighten and loosen said bracket displaceable means.

6. An adjustable desk assembly according to claim 1 wherein, said actuating means includes a reciprocating bolt carried by said desk bracket and engageable with said extension bracket displacement means.

7. An adjustable desk assembly according to claim 1 wherein, said extension top inner end is disposed in a spaced manner beneath said desk top undersurface.

8. An adjustable desk assembly according to claim 1 wherein, said desk top, extension top and at least one said end assembly each includes a wire access hole therethrough.

9. An adjustable desk assembly according to claim 1 wherein, said extension top is disposed adjacent one said desk end assembly and a storage enclosure attached beneath said desk top adjacent said other desk end assembly.

10. An adjustable desk assembly according to claim 5 wherein, said clamping means fasteners include hand manipulable knobs.

11. An adjustable desk assembly according to claim 6 wherein, said bolt includes a handle portion joined to a horizontal latch portion, and spring means urging said latch portion into engagement with said extension bracket displaceable means.

12. An adjustable desk assembly according to claim 8 wherein, said extension top wire access hole is disposed adjacent said extension bracket displaceable means and away from said desk top.

13. An adjustable desk assembly according to claim 8 wherein, said end assembly wire access hole is disposed through the uppermost portion of said end assembly.

14. An adjustable desk assembly according to claim 9 including, fastener components removably attaching said mounting assembly and storage enclosure beneath said desk top, mating fastener components on the undersurface of said desk top allowing the selective alternate attachment of said mounting assembly and storage enclosure adjacent either one of said desk and assemblies.

15. An adjustable desk assembly according to claim 9 including, a real panel on said desk extending between said desk end assemblies and a shelf removably attached beneath said desk top and extending between said desk end assemblies and behind said storage enclosure.

16. An adjustable desk assembly including a desk top having opposite end edges and front and rear edges, an end support assembly secured beneath said top adjacent each said end edge, an extension provided with a top attached to said desk and having inner and outer ends, a mounting assembly connecting said extension top inner end juxtaposed said desk top front edge, an end support assembly secured beneath said extension top adjacent said outer end, each said end assembly including a lowermost leg unit having means permitting independent vertical adjustment thereof, said mounting assembly including a desk bracket attached to the undersurface of said desk top adjacent said front edge and an extension bracket attached to the undersurface of said extension top adjacent said inner end, vertically and arcuately displaceable means on said extension bracket joined to said desk bracket, manually operable actuating means on said mounting assembly shiftable from a first position defining limits of horizontal arcuate displacement of said extension bracket and its attached top, to a second position allowing vertical displacement of said extension bracket and its attached top relative said desk top, each said end assembly including a pair of spaced apart corner elements having inner walls opposed to one another and each having a bottom normally elevated above an underlying floor, said leg unit having a base spanning the distance between said pair of corner element inner walls, said leg unit vertical adjustment means including a plurality of fastener receiving means vertically spaced in said inner walls and fastener means carried by said base and engageable with selected ones of said fastener receiving means whereby, the vertical disposition of said base may be selectively altered.

17. An adjustable desk assembly according to claim 16 including, at least one vertically adjustable glide extending from the bottom of each said leg unit base.

18. An adjustable desk assembly according to claim 16 including, an end panel on each said end assembly having a lower edge overlying said leg unit base, mating fastener components within said end assembly and on the inner face of said end panel, and alignment means on said end panel and within said end assembly to orient said panel during attachment to said end assembly.

19. An adjustable desk assembly according to claim 16 wherein, said fastener means include hairpin-shaped clips.

20. An adjustable desk assembly including, a desk top having opposite end edges and front and rear edges, an end support assembly secured beneath said top adjacent each said end edge, an extension provided with a top attached to aid desk and having inner and outer ends, a mounting assembly connecting said extension top inner end juxtaposed said desk top front edge, an end support assembly secured beneath said extension top adjacent said outer end, said mounting assembly including a desk bracket attached to the undersurface of said desk top adjacent said front edge and an extension bracket attached to the undersurface of said extension top adjacent said inner end, vertically and arcuately displaceable means on said extension bracket joined to said desk bracket, manually operable actuating means on said mounting assembly shiftable from a first position defining limits of horizontal arcuate displacement of said extension bracket and its attached top, to a second position allowing vertical displacement of said extension bracket and its attached top relative said desk top, said desk bracket including clamping means at one end engaging said extension bracket displaceable means, said clamping means provided with releasable fasteners operable to alternately tighten and loosen said bracket displaceable means, and said extension bracket displaceable means including a vertical circular pivot member fixedly attached beneath said extension top and provided with a plurality of vertically spaced apart keeper means adapted to engage said actuating means.

21. An adjustable desk assembly according to claim 20 wherein, said clamping means includes a pair of semi-circular collar segments.

22. An adjustable desk assembly according to claim 20 wherein, the longitudinal axis of said pivot member is disposed outside said desk top.

23. An adjustable desk assembly according to claim 20 wherein, said keeper means each includes a horizontally extending slot in the periphery of said pivot member.

24. An adjustable desk assembly according to claim 18 wherein, said alignment means includes a horizontal channel affixed within said end assembly and provided with a vertical stop flange and a horizontal channel attached to said end panel and including a depending catch flange engageable behind said stop flange.

25. An adjustable desk assembly according to claim 19 wherein, said clip includes a base having a pair of attachment legs, and said legs terminate in angled distal sections.

26. An adjustable desk assembly according to claim 19 wherein, said clip includes a base having a pair of attachment legs angled inwardly toward one another.

27. An adjustable desk assembly according to claim 23 wherein, said slots in said circular pivot member describe an arc of substantially 60° and are circumferentially located to permit displacement of said extension top substantially 30° to either side of a line normal to said desk top front edge.

28. An adjustable desk assembly including, a desk top having opposite end edges and front and rear edges, an end support assembly secured beneath said top adjacent each said end edge, an extension provided with a top attached to said desk and having inner and outer ends, a mounting assembly connecting said extension top inner end juxtaposed said desk top front edge, an end support assembly secured beneath said extension top adjacent said outer end, said mounting assembly including a desk bracket attached to the undersurface of said desk top adjacent said front edge and an extension bracket attached to the undersurface of said extension top adjacent said inner end, vertically and arcuately displaceable means on said extension bracket joined to said desk bracket, manually operable actuating means on said mounting assembly shiftable from a first position defining limits of horizontal arcuate displacement of said extension bracket and its attached top, to a second position allowing vertical displacement of said extension bracket and its attached top relative said desk top, said desk top provided with an undersurface having a series of fastener receiving components disposed adjacent one said desk end assembly, a second series of similarly arranged fastener receiving components in said undersurface disposed adjacent said other desk end assembly, and removable fasteners for attaching said desk bracket to either the right or left side of said desk top by insertion thereof in one of said series of fastener receiving components.

* * * * *